US006043013A

United States Patent [19]

Burns et al.

[11] Patent Number: 6,043,013

[45] Date of Patent: Mar. 28, 2000

[54] COLOR PHOTOGRAPHIC ELEMENT CONTAINING ELEMENTAL SILVER AND HETEROCYCLIC THIOL IN A NON-LIGHT SENSITIVE LAYER

[75] Inventors: Paul A. Burns; Louis E. Friedrich, both of Rochester; Stephen P. Singer, Spencerport; J. R. Vargas, Webster, all of N.Y.

[73] Assignee: Eastman Kodak Company, Rochester, N.Y.

[21] Appl. No.: 09/186,855

[22] Filed: Nov. 5, 1998

Related U.S. Application Data

[63] Continuation-in-part of application No. 09/014,857, Jan. 29, 1998, abandoned.

[51] Int. Cl.[7] ..... G03C 1/825; G03C 1/34

[52] U.S. Cl. ..... 430/507; 430/510; 430/611

[58] Field of Search ..... 430/507, 510, 430/611, 233

[56] References Cited

U.S. PATENT DOCUMENTS

| | | | |
|---|---|---|---|
| 3,227,554 | 1/1966 | Barr et al. | 430/222 |
| 3,266,897 | 8/1966 | Kennard et al. | 430/611 |
| 3,598,598 | 8/1971 | Herz . | |
| 3,647,439 | 3/1972 | Bass . | |
| 3,945,829 | 3/1976 | Zorn et al. | 430/510 |
| 4,366,231 | 12/1982 | Mayer et al. | 430/614 |
| 4,569,899 | 2/1986 | Inagaki et al. | 430/233 |
| 4,842,994 | 6/1989 | Sakanoue et al. | 430/955 |
| 4,886,738 | 12/1989 | Deguchi et al. | 430/611 |
| 4,952,485 | 8/1990 | Shibahara et al. | 430/502 |
| 5,063,145 | 11/1991 | Sakanoue | 430/955 |
| 5,081,008 | 1/1992 | Deguchi | 430/507 |
| 5,244,779 | 9/1993 | Asami | 430/611 |
| 5,362,620 | 11/1994 | Lamotte et al. | 430/611 |
| 5,573,901 | 11/1996 | Yamashita et al. | 430/567 |
| 5,573,903 | 11/1996 | Yamashita et al. | 430/600 |

FOREIGN PATENT DOCUMENTS

| | | |
|---|---|---|
| 0337370 | 10/1989 | European Pat. Off. . |
| 0454149 | 10/1991 | European Pat. Off. . |
| 0509519 | 10/1997 | European Pat. Off. . |
| 3-138639 | 6/1991 | Japan . |
| 1275701 | 5/1972 | United Kingdom . |
| 2280276 | 7/1993 | United Kingdom . |

*Primary Examiner*—Richard L. Schilling
*Attorney, Agent, or Firm*—Arthur E. Kluegel

[57] ABSTRACT

Disclosed is a photographic element comprising a non-light sensitive layer containing elemental silver and a heterocyclic thiol compound having a Clog P of at least 2.0 but less than 12.0, provided that the ring system of the compound comprises a —N═C—S—H group or its tautomer and does not react with an oxidized developer. The invention provides improved minimum densities in imaging layers.

17 Claims, No Drawings

COLOR PHOTOGRAPHIC ELEMENT CONTAINING ELEMENTAL SILVER AND HETEROCYCLIC THIOL IN A NON-LIGHT SENSITIVE LAYER

CROSS-REFERENCE TO RELATED APPLICATION

This application is a continuation-in-part of U.S. Ser. No. 09/014,857 filed Jan. 29, 1998.

FIELD OF THE INVENTION

This invention relates to a color photographic element containing elemental silver and a heterocyclic thiol compound in a non light sensitive layer.

BACKGROUND OF THE INVENTION

It has long been an object of silver halide-based color photographic materials to create an image of an object in an accurate manner, both in terms of color and image structure characteristics such as graininess and sharpness. It is well known that the perceived sharpness of photographic images can be degraded through halation effects; that is, the reflection and subsequent diffusion of light within the light capturing element; in particular, reflection from the support. It is well known to use antihalation layers between the support and the sensitized layers in films to reduce light reflection. To be effective, an antihalation layer contains materials that absorb light and prevent reflection. In general, it is highly desirable for the light absorbing materials to be totally removed from the film element (or otherwise made colorless) after development in order to avoid increased background density. One well known type of light absorbing material suitable for use in antihalation layers is colloidal or finely divided elemental or metallic silver (also referred to as 'gray' silver). This type of silver metal is in a filamentary form and, is such form, absorbs light across the visible spectrum appearing gray or black. It is generally easily removed from the film element by the normal bleaching and fixing steps used to remove imaging silver from the element. This silver metal is not light sensitive and does not contribute to image formation. For references, see T. H. James, The Theory of the Photographic Process, 4th Edition, p. 579, U.S. Pat. No. 3,434,839, JP 09-067122A2 and Y. J. Zahng et al, Chin. Chem. Lett. 7(7), 687–690(1996).

Another use of colloidal or finely divided elemental or metallic silver is as a blue light absorbing filter. This form, commonly referred to as Carey-Lea silver, differs from 'gray' silver by being spherical in form. For references, see F. Evva, J. Signalaufzeichnungmaterialien, 4(1), 43–60 (1976) and G. Frens, Kolloid-Z.Z. Polym, 233(1–2), 922–9 (1969). This material is generally located in a non-imaging layer (commonly referred to as a yellow filter layer) farther away from the exposing source than or "underneath" the blue light sensitive emulsion layer. The function of this layer is to absorb any blue light not captured by the blue sensitized layers, thus avoiding undesired exposure by blue light of the underlying green and red sensitized emulsion layers, which retain some inherent sensitivity to blue light.

A problem associated with the use of elemental silver in both antihalation and yellow filter layers is an undesired increase in fog in nearby imaging layers. During development, silver ions are released and/or made soluble from the imaging layer. These silver ions can migrate to a non-light sensitive layer where the elemental silver is present. The silver can serve as nuclei for the reduction of the migrating silver ions to silver metal with concurrent oxidation of developer to oxidized developer. This process is called solution physical development (for references, see T. H. James, ibid., Chapter 13) and is non-imagewise. The oxidized developer can diffuse out of the antihalation layer and back into the nearby imaging layer where it can react with the couplers present and form dye in a non-imagewise fashion. This process is often highly process sensitive and can lead to variations in Dmin during photofinishing.

Another problem with the use of elemental silver in non-imaging layers is that these layers can absorb inhibitor fragments and other silver absorbing materials. This results in lower effective concentrations of the free species in the imaging layers. Restricted diffusion of such species through the layer containing the elemental silver can also occur.

It is known that the solution physical development involving elemental silver can be modified by the use of additives. For example, GB 2280276 A1, U.S. Pat No. 3,647,439, DE 1949418, East German Patent 2006 91/6 and Japanese Patent Application (Kokai) JP 3-138639A2 all describe various classes of materials, including thiols of various types, that are useful for controlling the properties of elemental silver. In particular, the '439 and '91/6 references describe among others, the use of various types of heterocyclic thiols for use in non-light sensitive layers. However, in all of these references, the materials are water soluble and, of all the examples of heterocyclic thiols shown, the average ClogP is 1.66 with a maximum ClogP is 3.18 (compound 11 in Table II of '91/6). Such water soluble materials can undesirably diffuse to imaging layers where they can cause inhibition of development and loss of sensitivity to light.

Solution physical development can be promoted by materials that form soluble silver salts. In particular, materials that release low molecular weight water solubilized thiols, which are used as bleach accelerators, can increase the amount of solution physical development. Couplers that release such thiols are known are bleach accelerator releasing couplers; for examples, see EP 193389, U.S. Pat. No. 4,861,701; U.S. Pat. No. 4,959,299; U.S. Pat. No. 4,912,024; U.S. Pat. No. 5,300,406 and U.S. Pat. No. 5,358.828. It is also possible to release the same bleach accelerators from materials other than couplers by imagewise means that do not involve direct coupling with oxidized developer; for example, see U.S. Pat. No. 4,684,604 or by non-imagewise means, for examples, see U.S. Pat. No. 4,923,784, U.S. Pat. No. 4,865,956 and U.S. Pat. No. 5,019,492. Thus, increases in Dmin in imaging layers near to non-imaging layers which contain collodial silver are particularly problematic when bleach accelerators are also present.

Substituted mercaptotetrazoles are commonly known in the art either as inhibitor fragments and as antifoggants. As inhibitor fragments, they are attached to a coupling moiety through a sulfur or nitrogen atom and do not interact with silver until coupling occurs and the sulfur atom is freed; for example, see U.S. Pat. No. 3,227,554 and C. R. Barr et al, Photogr. Sci. Eng., 74, 214 (1969). As part of a DIR, the mercaptotetrazole does not have a free —S—H or —N—H group. Generally, it is desirable that the mercaptotetrazoles released from DIRs are partially water soluble so that they are free to diffuse to other layers to cause interimage. As antifoggants, these materials are generally at least partially water soluble or soluble in water-miscible solvents such as methanol and are added directly to silver emulsions before coating of the film or added directly to the developer solutions. The use of various solubilized mercaptotetrazoles as antifoggants is shown, for example, in Research Disclosure, June 1984, pp 274–278; U.S. Pat. No. 4,952, 485; U.S. Pat. No. 5,362,620; U.S. Pat. No. 5,244,779; U.S. Pat. No. 4,963,475; U.S. Pat. No. 3,266,897; Belgian Patent 747,628, UK Patent 1,275,701; JP-05-313282; EP 454149A1; JP-02-207248; EP 509519A2 and EP 337370A2.

EP 0 369 486B1 describes the use of 2-mercapto-benzoxazoles,-benzothiazoles and -benzodiazoles for use in combination with fine silver halide emulsions in a protective layer, where the light sensitivity of the fine silver halide emulsions are more than 1 exposure unit less sensitive to light than the least sensitive silver halide emulsions present in another layer. JP-03-163435A2 discloses the use of mercaptooxadiazole derivatives with virtually non-photosensitive silver halide emulsions. In both of these references, the silver halide emulsions are not elemental silver.

A problem to be solved is to provide a photographic element containing a non-light sensitive layer containing elemental silver which has a reduced tendency to increase the Dmin of nearby light sensitive layers.

SUMMARY OF THE INVENTION

The invention provides a photographic element comprising a non-light sensitive layer containing elemental silver and a heterocyclic thiol compound having a Clog P of at least 2.0 but less than 12.0, provided that the ring system of the compound comprises a —N═C—S—H group or its tautomer and does not react with an oxidized developer.

The invention provides a reduction in Dmin values of the imaging layers.

DETAILED DESCRIPTION OF THE INVENTION

The photographic element of the present invention is generally as described in the Summary of the Invention. Typically, it relates to a light sensitive color photographic element with at least one red sensitive silver halide emulsion layer containing at least one non-diffusing cyan coupler, at least one green sensitive silver halide emulsion layer having at least one non-diffusing magenta coupler and at least one blue sensitive silver halide emulsion layer having at least one non-diffusing yellow coupler, and at least one non-light sensitive layer containing both a form of elemental silver metal and a heterocyclic thiol having an overall ClogP of at least 2.0 but less than 12.0 according to Formula I.

I

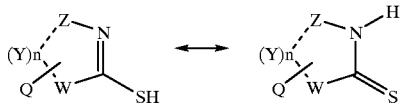

In Formula I, W, Y and Z may be any combination of nitrogen, oxygen, sulfur and carbon atoms necessary to complete a 5 or 6 membered heterocyclic ring system. n is 1 or 2. Q is a ballast moiety permanently attached to any part of the heterocyclic ring system such that the total ClogP of the compound is at least 2.0 but less than 12.0. The bonds (shown as dotted lines) between the W, Y and Z atoms are single or double as necessary to complete the ring. Any carbon atom that is present in the ring may have a hydrogen atom or other substituent such as an alkyl group, a phenyl group, an ether group, a thioether group, a nitrogen group such as amino, aminocarbonyl or aminosulfonyl, an oxygen, a sulfoxide group, a sulfone group, a halide such a chloro or bromo, a cyano group, a nitro group, a carbonyl group such as keto, carboxylic acid, carboxylate ester, carbamoyl or such other substituent group as described generally hereafter These substituents may be connected to others to form additional ring systems and benzo or naptho rings may be annulated to the heterocyclic ring nucleus. The compound according to Formula I can be written in two tautomeric forms; either in a —N═C—S—H form or in a —NH—C═S form. These two forms are chemically identical; for uniformity, the compounds of the invention will be written only in the —N═C—S—H form.

Some examples of the ring systems of Formula I of the invention are mercaptotetrazoles, mercapto-1,2,3 triazoles, mercaptotetraazaindenes, mercaptopurines, mercaptopyrazolotriazoles, thiopyrimidines, oxazolididine-2-thiones, thiazolines, cyclic thioureas, pseudothiohydantoins, 2-thioimidazolidines, mercaptoimidiazoles, mercaptooxazoles, mercaptooxadiazoles, mercaptothiadiazoles and the like. The most preferred ring systems for use in this invention are mercaptotetrazoles mercaptooxadiazoles and mercaptothiadiazoles.

In the compound according to Formula I, Q is a ballast substituent that provides sufficient bulk, molecule weight and oil solubility such the ClogP requirements of the definition are met and the compound is substantially unable to diffuse into other layers. Suitable Q groups include substituted or unsubstituted alkyl or aryl groups containing 8 to 48 carbon atoms, alkyloxy or aryloxy groups, carbonamido (—NRCO—) or carbamoyl (—CONR—) groups, sulfonamido (—$NRSO_2$—) or sulfamoyl (—$SO_2NR$—) or alkylthiol or arylthiol groups. Representative additional substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The materials of Formula I are not couplers and do not react with oxidized developer. Such reaction would adversely affect color, image forming efficiency, etc.

An important feature of the heterocyclic thiols of Formula I is their oil/water partition coefficient. The oil/water partition coefficient can be calculated using the software program Medchem 3.54 to predict this value as ClogP (Calculated log partition coefficient). Medchem version 3.54 is a software program produced by the Medicinal Chemistry Project, Pomona College, Pomona Calif. It is believed that, in order to obtain the desired reduction of Dmin and fog in nearby imaging layers, the water solubility cannot be so low that the material is unable to interact effectively with the silver surface. In addition, high ClogP results in the inability to remove the corresponding silver salt during the bleaching and fixing steps of the process. Thus, it is preferred that the overall ClogP of the heterocyclic thiols of Formula I are not greater than 12.0 and most preferred that the ClogP is not greater than 6.0. It is also believed, however, that the water solubility cannot be so high that the material can diffuse away from the layer containing the elemental silver into adjacent imaging layers thereby causing a loss in light sensitivity. Thus, it is necessary that the ClogP of the heterocyclic thiol of Formula I be at least 2.0 or more preferably at least 3.0 or most preferably at least 3.5.

In general, the molar ratio of heterocyclic thiol of Formula I to silver should be at least 0.1 and more preferably, at least 1.0 but less than 100 and more preferably, less than 50.

The heterocyclic thiols of Formula I can be incorporated into the non-light sensitized layer either in the protonated form as shown, or as the corresponding deprotonated salt. Suitable counter ions would be metal cations such as sodium ($Na^+$) or potassium ($K^+$) or ammonium cations such as tetramethylammonium ($N(CH_3)_4^+$), tetraethylammonium ($N(C_2H_5)_4^+$) or cyclohexylammonium ($C_6H_{13}NH_3^+$).

The following are examples of heterocyclic thiols that are useful in this invention along with the corresponding ClogP values in parentheses:

HT-1: (3.72)

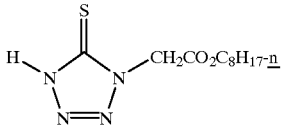

HT-2: (3.76)

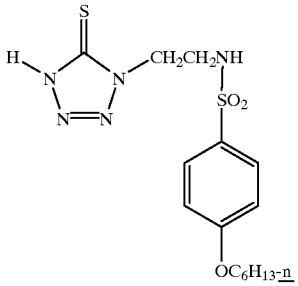

HT-3: (2.21)

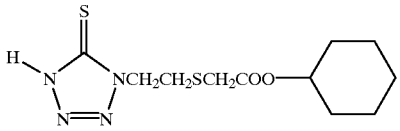

HT-4: (3.65)

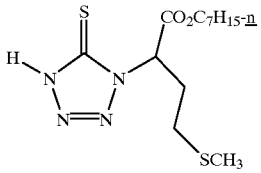

HT-5: (4.71)

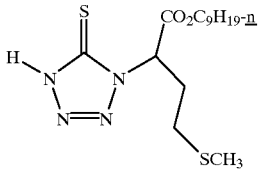

HT-6: (4.29)

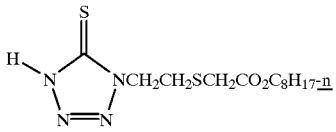

-continued

HT-7: (2.31)

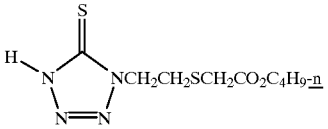

HT-8: (4.56)

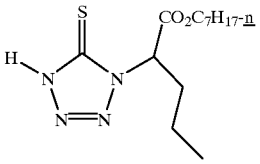

HT-9: (3.71)

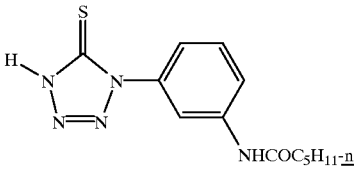

HT-10: (4.77)

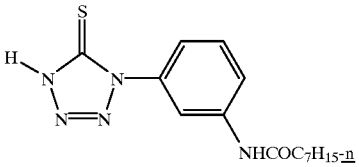

HT-11: (6.36)

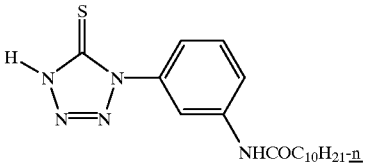

HT-12: (2.61)

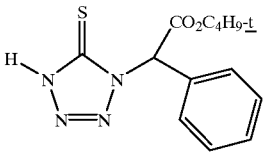

HT-13: (9.01)

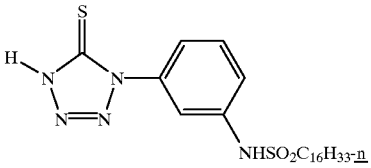

HT-14: (8.73)

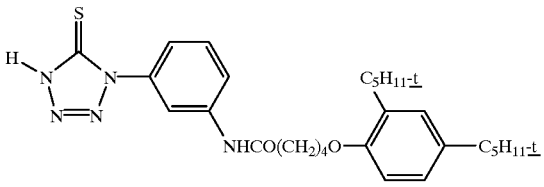

-continued
HT-15: (5.73)
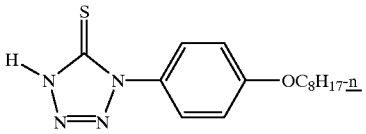
HT-16: (6.68)
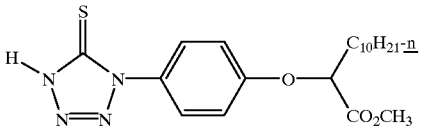
HT-17: (8.65)
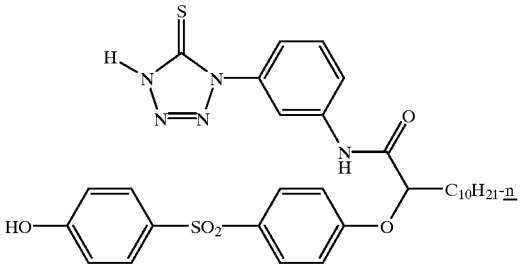
HT-18: (7.16)
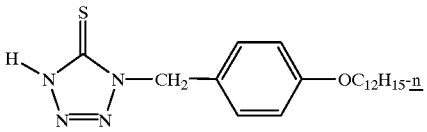
HT-19: (2.52)
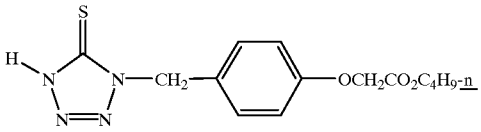
HT-20: (11.56)
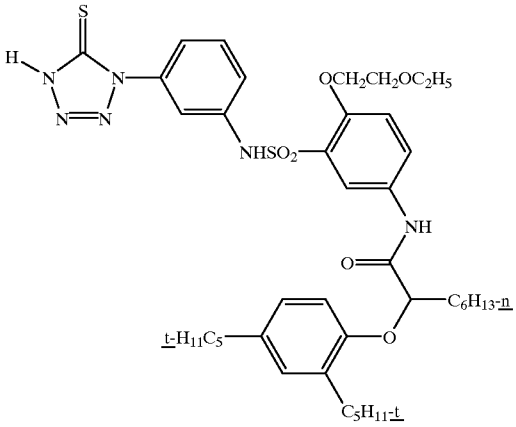
HT-21: (4.59)
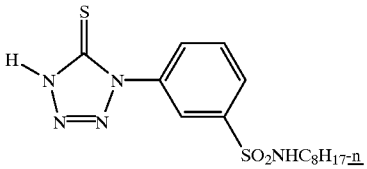
-continued
HT-22: (5.73)
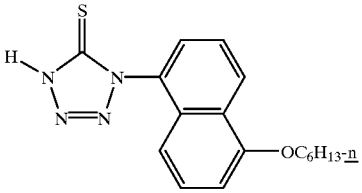
HT-23: (5.95)
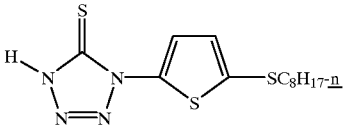
HT-24: (10.5)
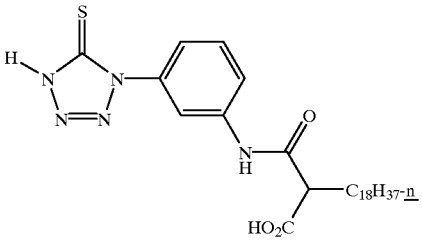
HT-25: (3.98)
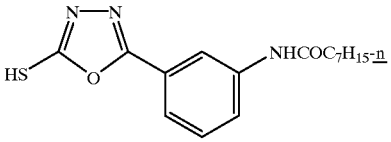
HT-26: (3.07)
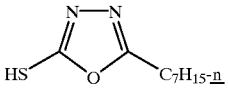
HT-27: (2.81)
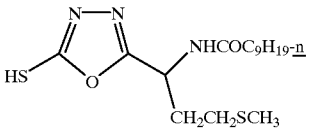
HT-28: (4.86)
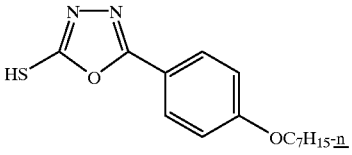
HT-29: (2.05)
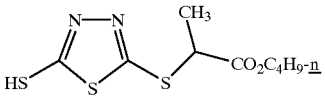
HT-30: (4.30)
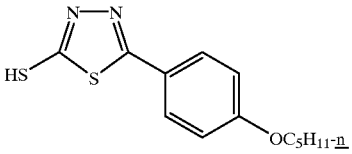

-continued

HT-31: (3.45)

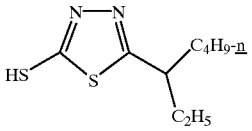

HT-32: (2.88)

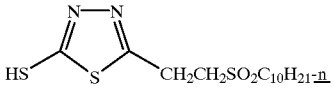

HT-33: (5.36)

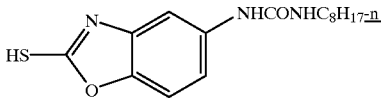

HT-34: (3.62)

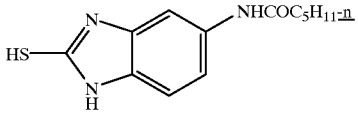

HT-35: (4.43)

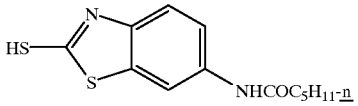

HT-36: (3.52)

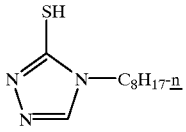

HT-37: (8.28)

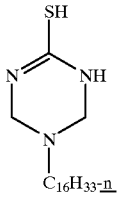

HT-38: (4.16)

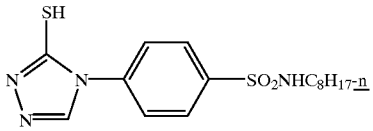

The heterocyclic thiols of the invention are conveniently employed with the compounds typically used as scavengers for oxidized developer. Such scavengers are described in Research Disclosure as described hereinafter and include, for example, phenolic and hydroquinone derivatives such as 2,4-di-t-octyl-hydroquinone.

The materials of the invention can be added to a solution containing silver before coating or be mixed with the silver just prior to or during coating. In either case, additional components like couplers, doctors, surfactants, hardeners and other materials that are typically present in such solutions may also be present at the same time. The materials of the invention are not water soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent that is stabilized by suitable surfactants and surface active agents usually in combination with a binder or matrix such as gelatin. The dispersion may contain one or more permanent coupler solvent that dissolves the material and maintains it in a liquid state. Some examples of suitable permanent coupler solvents are tricresylphosphate, N,N-diethyllauramide, N,N'-dibutyllauramide, p-dodecylphenol, dibutylpthalate, di-n-butyl sebacate, N-n-butylacetanilide, 9-octadec-en-1-ol, trioctylamine and 2-ethylhexylphosphate. The dispersion may require an auxiliary coupler solvent to initially dissolve the component but is removed afterwards, usually either by evaporation or by washing with additional water. Some examples of suitable auxiliary coupler solvents are ethyl acetate, cyclohexanone and 2-(2-butoxyethoxy) ethyl acetate. The dispersion may also be stabilized by addition of polymeric materials to form stable latexes. Examples of suitable polymers for this use generally contain water solubilizing groups or have regions of high hydrophilicity. Some examples of suitable dispersing agents or surfactants are Alkanol XC or saponin. The materials of the invention may also be dispersed as an admixture with another component of the system such as a coupler or a oxidized developer scavenger so that both are present in the same oil droplet.

Throughout this specification, unless otherwise specifically stated, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'- ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in Research Disclosure, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, Research Disclosure, June 1994, Item 36230, provides suitable embodiments.

In the following discussion of suitable materials for use in the emulsions and elements of this invention, reference will be made to Research Disclosure, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 Research Disclosure, Item No. 36544 referenced above, is updated in the September 1996 Research Disclosure, Item No. 38957. Certain desirable photographic elements and processing steps, including those useful in conjunction with color reflective prints, are described in Research Disclosure, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0389 817; EPO 0 487 111; EPO 0488 248; EPO 0 539 034; EPO 0545 300; EPO 0556 700; EPO 0 556 777; EPO 0556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0341 204; EPO 347,235; EPO 365,252; EPO 0 422 595; EPO 0428 899; EPO 0428 902; EPO 0 459 331; EPO 0467 327; EPO 0476 949; EPO 0 487 081; EPO 0 489 333; EPO 0 512 304; EPO 0 515 128; EPO 0534703; EPO 0 554 778; EPO 0558 145; EPO 0571 959; EPO 0583 832; EPO 0 583 834; EPO 0584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. No. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0415 375; EPO 0437 818; EPO 0447 969; EPO 0 542 463; EPO 0 568 037; EPO 0 568 196; EPO 0568 777; EPO 0570 006; EPO 0573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. These bleach-releasing materials may or may not be couplers as described in the background. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

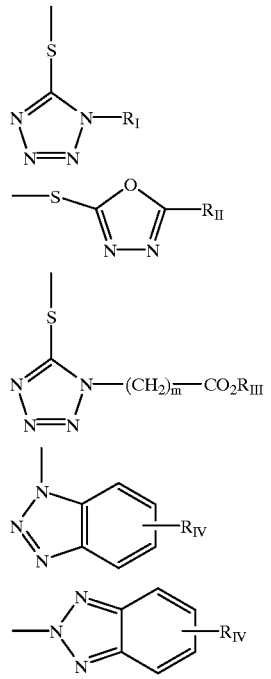

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein RV is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. No. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

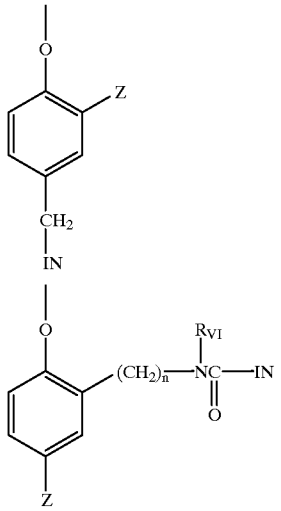

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Aside from the compound of Formula II of the invention, suitable developer inhibitor-releasing couplers that may be included in photographic light sensitive emulsion layer include, but are not limited to, the following:

D1

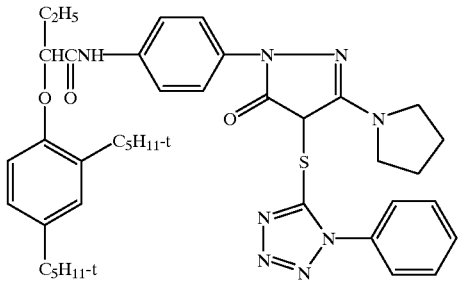

D2

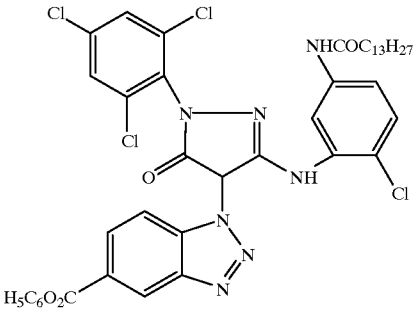

D3

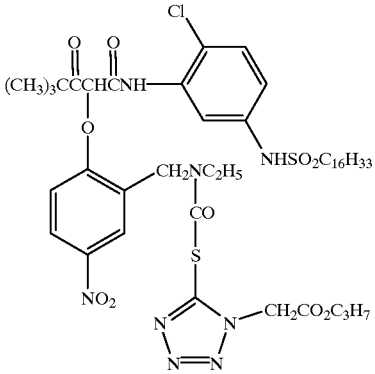

D4

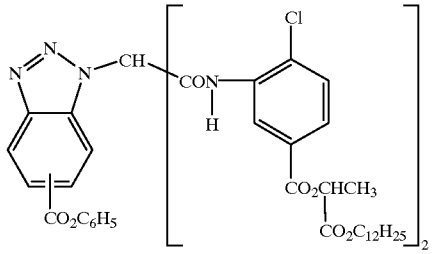

D5

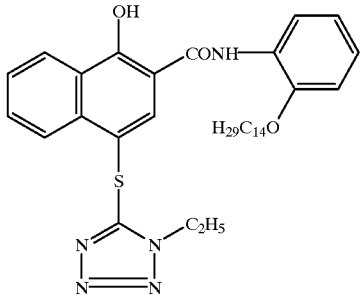

-continued

D6

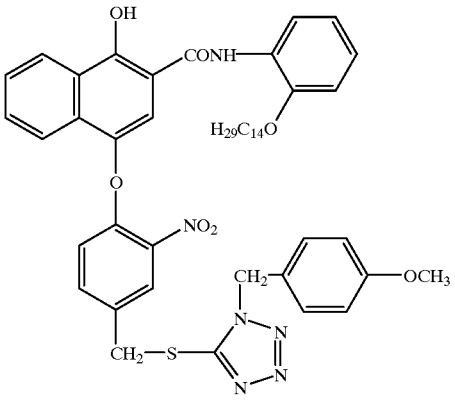

D7

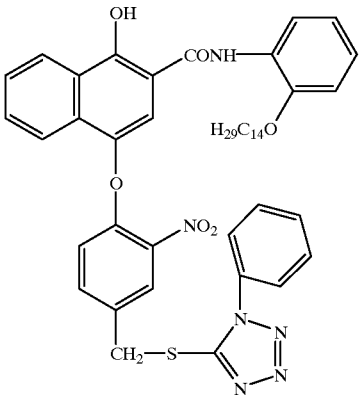

D8

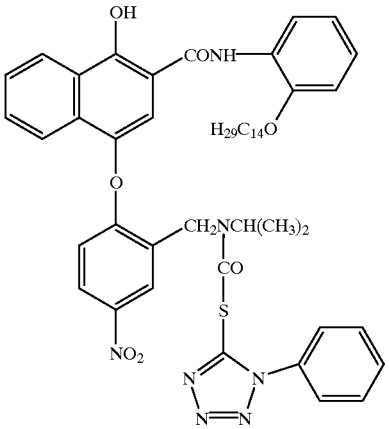

D9

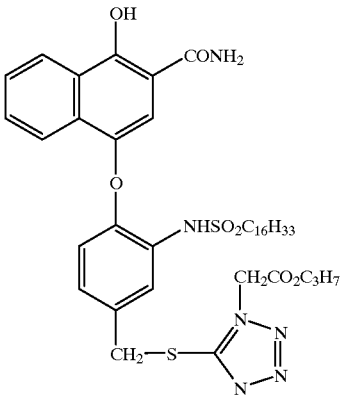

-continued

D10

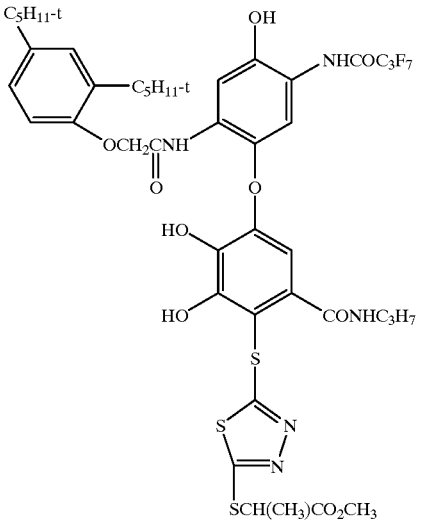

D11

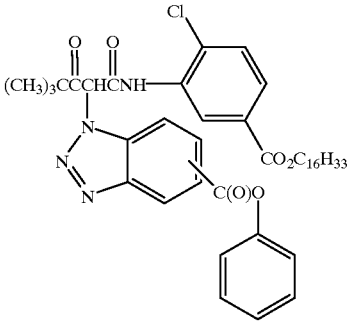

D12

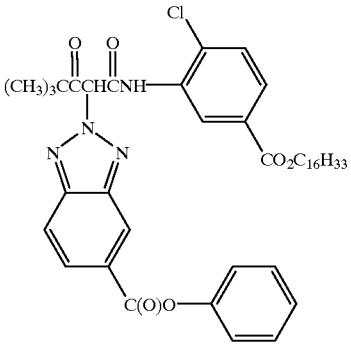

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. No. 5,310,635; 5,320,938; and 5,356,764.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of total grain projected area. Preferred tabular grain emulsions are those in which the average thickness of the tabular grains is less than 0.3 micrometer (preferably thin— that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. No. 4,414,310 and 4,914,014, Sowinski et al U.S. Pat. No. 4,656,122, Piggin et al U.S. Pat. 5,061,616 and 5,061,609, Tsaur et al U.S. Pat. No. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

Synthesis

The compounds of the invention are readily prepared through conventional techniques. The following is a suitable synthesis of HT-4.

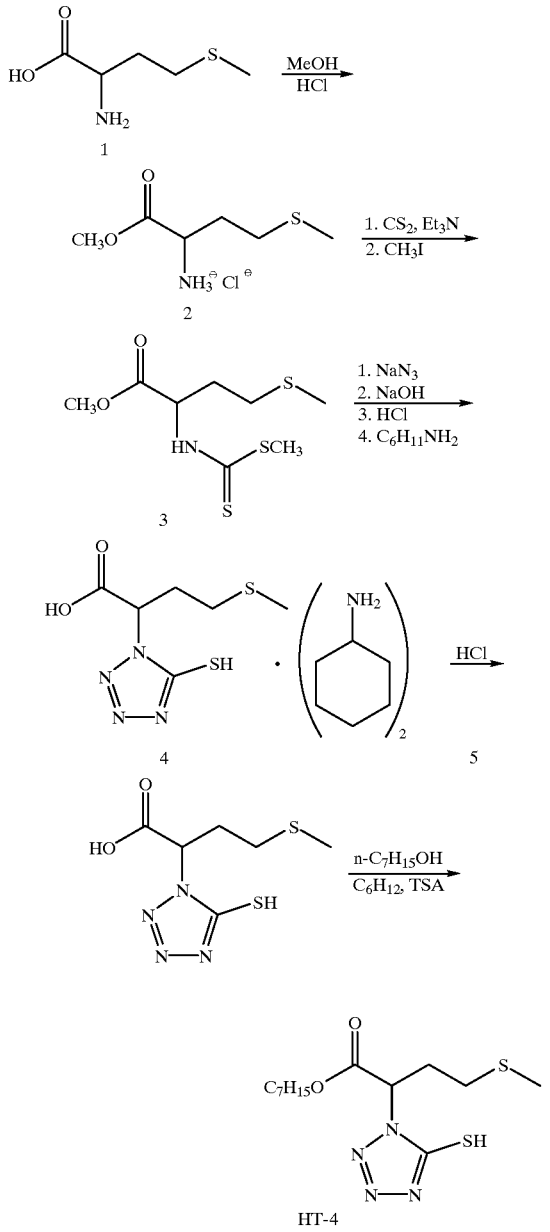

DL-Methionine methyl ester hydrochloride(2). Anhydrous methanol (1.5 L) was placed in a 5 L three-neck flask fitted with an addition funnel and a gas outlet leading to a bubbler. The methanol was cooled in an ice bath for 15 min. Acetyl chloride (790g, 10.05 mol) was added at a rate such that loss of HCl gas through the bubbler was minimal. After the addition the solution was stirred for 15 min and then DL-methionine (1)(500g, 3.35 mol) was added in three potions over 20 min. After all the solid dissolved 2,2-dimethoxypropane (700g, 6.7 mol) was added over 10 min to give a light orange-brown solution. After three days at room temperature the solution was evaporated in vacuo, and the residual dark red oil poured into acetone (3 L). The oil was stirred until it solidified. After 0.5 h the solid was filtered and washed with acetone (2×250 mL) to remove most of the colored impurities. The solid was triturated again with acetone (2 L) and filtered again to give a colorless solid. The solid was dried in vacuo; yield: 513 g. The combined filtrates were evaporated in vacuo, and the residue treated in the same manner as above to yield 111 g compound 2. Total yield: 624 g, 93%.

Compound 3. Methanol (1.5 L) was added to a 5 L three-necked flask fitted with a mechanical stirrer, thermometer, and reflux condenser. DL-Methionine methyl ester hydrochloride (2) (500 g, 2.5 mol) was added (mildly exothermic), and the warm solution was cooled in an ice bath to 15° C. Carbon disulfide (238 g, 3.13 mol) was added all at once. Triethylamine (556 g, 5.51 mol) was added in four portions, keeping the temperature below 20° C. The ice-bath was removed, and the solution heated to reflux for 0.5 h. The light yellow solution was then cooled to 10° C., and iodomethane (436 g, 3.00 mol) added in four portions, keeping the temperature below 30° C. After each potion was added the solution was re-cooled to 15° C. before adding the next potion. After the addition the ice-bath was removed, and the solution stirred for 1 h. The solution was then evaporated in vacuo until triethylamine hydrochloride began to precipitate. The reaction mixture was poured into a mixture of water (2 L) and concentrated hydrochloric acid (200 mL) with rapid stirring to form a solid. The solution was decanted from the settled solid; the pale yellow solid was washed with water (3×1 L), decanting each time. It was then filtered and washed with water (3×500 mL). The product was dried in vacuo at 50° C. over $P_2O_5$ to give 562 g compound 3; yield: 88%.

Compound 4. Sodium azide (52.2 g, 0.803 mol) was added to water (200 mL) in a 2 L three-neck flask fitted with a mechanical stirrer and a reflux condenser. A gas outlet tube from the condenser was connected to the sidearm of a 4 L filter flask containing bleach (3 L) in order to destroy the methanethiol evolved during the reaction. A rubber stopper was placed lightly on the top of the filter flask, and the stirred bleach was cooled in an ice bath. Compound 3 (185 g, 0.730 mol) and isopropanol (400 mL) were added to the $NaN_3$ solution, and the thick slurry stirred and slowly heated to reflux. A clear solution was obtained and the evolution of gaseous methanethiol become vigorous before reflux was reached. The heating was discontinued for several minutes to allow the rate of methanethiol evolution to diminish. The solution was then gently refluxed for 1.5 h, after which the light yellow solution was cooled to room temperature. To the solution was added 50% aqueous NaOH solution (73 g, 0.91 mol), raising the solution temperature to 55° C. After 10 min the light orange solution was cooled to 10° C. The solution was acidified with concentrated hydrochloric acid (140 mL); the resulting pH was 3. Another 10 mL of concentrated hydrochloric acid was added, and the separated oil was extracted with dichloromethane (400 and 2×100 mL). The extract was dried (MgSO4), filtered, and evaporated in vacuo to give an oil (170 g). The oil was dissolved in acetone (450 mL) and cooled in an ice bath to 20° C. Cyclohexyl amine (145 g, 1.46 mol) was added with stirring; a precipitate quickly formed. After cooling 0.5 h the solid was filtered and washed with acetone to give the bis-cyclohexylamine salt (4) (209 g, 66%), mp 205° C. (dec).

Compound 5. Compound 4 (265 g, 0.612 mol) was placed in a 1 L Erlenmeyer flask and water (125 mL) added. To the hand-stirred slurry was added, in three portions, concentrated hydrochloric acid (125 mL). There was no exotherm. The thick slurry was extracted with ethyl acetate (2×500 mL and 5×200 mL). The ethyl acetate extract was washed with 6 N hydrochloric acid (2×25 mL) and brine (25 mL). The extract was dried ($MgSO_4$), filtered, and concentrated in vacuo to 200 mL. The solution was diluted with dichloromethane (350 mL) and then saturated with heptane. After 2 h the colorless solid was filtered, washed with dichloromethane, and dried in vacuo at 45° C. over $P_2O_5$ to obtain compound 5 (105 g, 73%), a colorless solid, mp 83–85° C. Concentration of the filtrate gave a second crop (24 g, 17%).

Compound 6 (HT-4). Compound 5 (15.0 g, 64 mmol), n-heptanol (14.9 g, 128 mmol), and cyclohexane (75 mL) were combined in a flask fitted with a Dean-Stark trap filled with four angstrom molecular sieves. Toluenesulfonic acid (1.5 g) was added, and the solution was refluxed gently, following the reaction by thin layer chromatography (15% methanol in dichloromethane). After 2 h the clear, colorless solution was cooled to room temperature and diluted with ethyl acetate (200 mL). The solution was washed with 10% sodium bicarbonate (2×25 mL), 3N hydrochloric acid (50 mL), water (25 mL), and brine (50 mL). The solution was evaporated in vacuo, finally at 5 torr at 90° C. to give a very pale yellow oil (21.8 g, theoretical yield: 21.3).

PHOTOGRAPHIC EXAMPLES

A- Antihalation Layer

Bilayer photographic elements were prepared by coating the following layers on a cellulose triacetate film support (coverages are in g/m$^2$). Unless otherwise noted, all comparative and inventive compounds were dispersed in twice their own weight of N,N-dibutyllauramide:

Layer 1 (Antihalation Layer): Gelatin at 2.04, black colloidal silver at 0.135, UV-1 at 0.075 and UV-2 at 0.075. The inventive and comparative materials, when present, were added at 0.0081. ILS- 1, when present, was added at 0.162.

Layer 2 (Cyan Layer): gelatin at 1.61, C-1 at 0.48, C-2 at 0.075, C-3 at 0.015 and 0.683 red sensitized AgIBr tabular emulsion.

Layer 3 (Overcoat): gelatin at 5.38 and 0.016 bis-vinylsulfonemethylether

The structures of the couplers and comparative materials used, along with the corresponding ClogP where appropriate, in the above format are as follows:

UV-1:

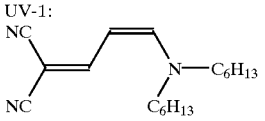

UV-2:

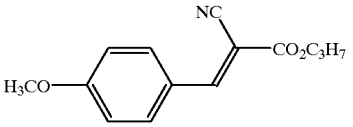

C-1:

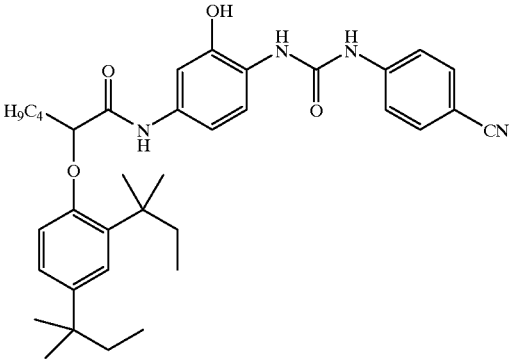

-continued

C-2:

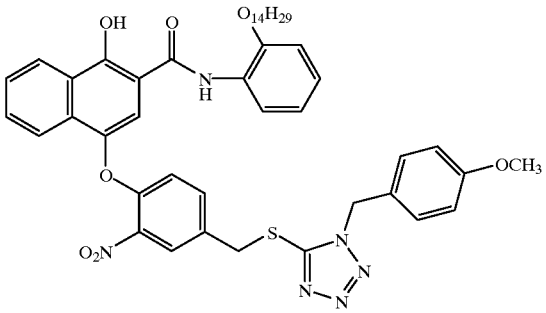

C-3:

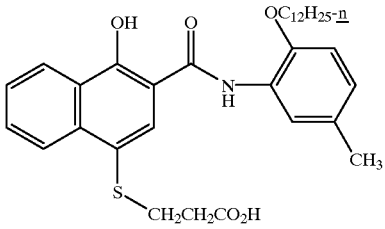

ILS-1:

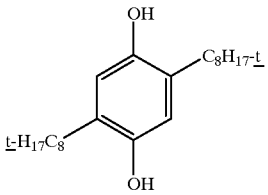

CHT-1:

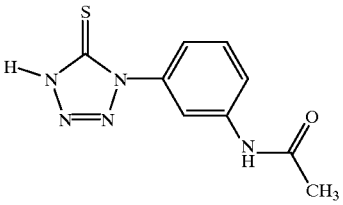

(1.60)

CHT-2:

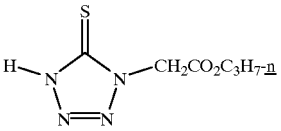

(1.08)

CHT-3:

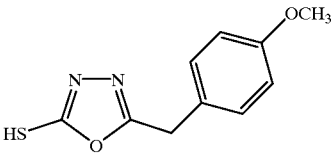

(1.22)

CHT-4:

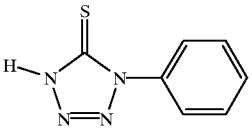

(1.91)

Samples of each element were given a stepped exposure and processed in the KODAK FLEXICOLOR (C41) process as described in *British Journal of Photography Annual*, 1988, pp. 196–198. Contrast of the elements was determined using the maximum slope between any two density points. Relative red sensitivity, a measure of speed, was determined by measuring the speed point +0.15 density units above Dmin and normalizing to the check position. Results are shown in Table I.

TABLE I

Use of Heterocyclic Thiols in Antihalation Layers - Bilayer Format

| Sample | Comp/ Inv | Additive | Red Dmin | Contrast | Relative Red Sensitivity | CLogP |
|---|---|---|---|---|---|---|
| BL-1 | Comp | None | 0.210 | 1.11 | 1.00 | |
| BL-2 | Comp | ILS-1 | 0.150 | 1.11 | 1.02 | |
| BL-3 | Comp | CHT-1 | 0.210 | 1.09 | 0.94 | 1.60 |
| BL-4 | Comp | CHT-2 | 0.180 | 1.07 | 0.95 | 1.08 |
| BL-5 | Comp | CHT-3 | 0.105 | 1.09 | 0.90 | 1.22 |
| BL-6 | Comp | CHT-4 | 0.106 | 1.21 | 0.93 | 1.91 |
| BL-7 | Inv | HT-4 | 0.116 | 1.07 | 1.00 | 3.65 |
| BL-8 | Inv | HT-4 + ILS-1 | 0.091 | 1.04 | 1.01 | |
| BL-9 | Inv | HT-9 | 0.093 | 1.21 | 1.00 | 3.71 |
| BL-10 | Inv | HT-26 | 0.103 | 1.00 | 0.99 | 3.07 |
| BL-11 | Inv | HT-37 | 0.161 | 1.15 | 1.00 | 8.28 |

Sample BL-2 shows the effect of adding a hydroquinone scavenger for oxidized developer to the antihalation layer, a common method for removing unwanted oxidized developer. However, this alternative is not as effective at lowering red Dmin as are the compounds of the invention. BL-3 to BL-6 demonstrate that the CLogP must be sufficiently high to prevent wandering of the heterocyclic thiol into imaging layers and causing losses in light sensitivity. These examples achieve reduction in Dmin but exhibits an undesired reduction in Relative Red Sensitivity at the same time. Samples BL-7 to BL-11 show that the compounds of the invention are useful for controlling the Dmin of adjacent layers without significantly their affecting light sensitivity. Sample BL-8 shows that the combination of the inventive materials with an oxidized developer scavenger is even more effective.

15 B- Multilayer Photographic Examples

The invention can be further illustrated in the following multilayer experiments. Component laydowns are provided in units of gm/sq m.

Layer A (Protective Overcoat Layer).

Layer B (UV Filter Layer).

Blue Sensitized Layer

Layer C (Yellow Filter Layer): ILS-1 at 0.054 and gelatin at 0.807.

Green Sensitized Layer

Layer D (Interlayer): ILS-1 at 0.075 and gelatin at 0538.

Red Sensitized Layer

Layer E (Interlayer): gelatin at 0.538 and ILS-1 at 0.076.

Layer F (Antihalation layer): gelatin at 1.61 and UV-1 and UV-2 both at 0.076.

Bislvinylsulfonyl)methane hardener was added at 1.55% of total gelatin weight. Antifoggants (including 4-hydroxy-6-methyl-1,3,3a,7-tetraazaindene), surfactants, coating aids, coupler solvents, emulsion addenda, sequestrants, lubricants, matte and tinting dyes were added to the appropriate layers as is common in the art. The structures of the additional compounds used in the multilayer examples are as follows.

Multilayer examples ML- 1 to 8 which all employ the same basic formula with variations in the AHU with and without an interlayer are summarized in Table III. Samples of each element were given a stepped exposure and processed in the KODAK FLEXICOLOR (C-41) process as described in *British Journal of Photography Annual*, 1988, pp 196–198.

TABLE III

Multilayer Formulation Variations in AHU and Red Dmins

| Example | Comp/Inv | Layer E (IL) | Layer F (AHU) | Red Dmin |
|---|---|---|---|---|
| ML-1 | Comp | Present | +BCS (0.15)* | 0.207 |
| ML-2 | Comp | Omit | " | 0.309 |
| Ml-3 | Comp | Omit | Omit BCS* | 0.197 |
| ML-5 | Inv | Omit | BCS (0.15)* + HT-4 (0.009) | 0.226 |
| ML-6 | Inv | Omit | BCS (0.15)* + HT-4 (0.018) | 0.214 |

*BCS = Black Colloidal Silver

Variability of Dmin within a multilayer film is very undesirable. While addition of an interlayer (layer E) between the AHU and imaging layers does decrease red Dmin, it requires an undesirable increase in film thickness and well as an additional layer. As demonstrated by examples ML-2 and ML-3, black colloidal silver (BCS) in the AHU Layer plays a significant role in causing increased red Dmin. The addition of the inventive materials like HT-4 to the AHU layer containing black colloidal silver gave low red Dmin even when the protective E interlayer was omitted (Examples ML-5 and ML-6) and a bleach accelerating releasing coupler like C-3 was present.

The invention has been described in detail with particular reference to preferred embodiments thereof, but it will be understood that variations and modifications can be effected within the scope and spirit of the invention.

What is claimed is:

1. A color photographic element comprising at least one red sensitive silver halide emulsion layer containing at least one cyan coupler, at least one green sensitive silver halide emulsion layer having at least one magenta coupler, and at least one blue sensitive silver halide emulsion layer having at least one yellow coupler and a non-light sensitive layer containing elemental silver and a heterocyclic thiol compound having a Clog P of at least 2.0 but less than 12.0, provided that the ring system of the compound comprises a —N═C—S—H group or its tautomer and does not react with an oxidized developer, and provided that the heterocyclic thiol compound is present as a dispersion in a hydrophobic organic solvent.

2. The color photographic element of claim 1 wherein the heterocyclic thiol is a mercaptotetrazole.

3. The color photographic element of claim 1 wherein the heterocylic thiol is a mercaptooxadiazole.

4. The color photographic element of claim 1 wherein the heterocylic thiol is a mercaptothiadiazole.

5. The color photographic element of claim 1 where the ClogP of the heterocyclic thiol is at least 3.0 but less than 6.0.

6. The color photographic element of claim 1 where the ClogP of the heterocyclic thiol is at least 3.5 but less than 6.0.

7. The color photographic element of claim 2 where the ClogP of the heterocyclic thiol is at least 3.0 but less than 6.0.

8. The color photographic element of claim 2 where the ClogP of the heterocyclic thiol is at least 3.5 but less than 6.0.

9. The color photographic element of claim 1 where the elemental silver is colloidal silver and is neutral in color.

10. The color photographic element of claim 1 where the elemental silver is colloidal silver and is yellow in color.

11. The color photographic element of claim 1 where the heterocyclic thiol is selected from the following compounds:

HT-4:

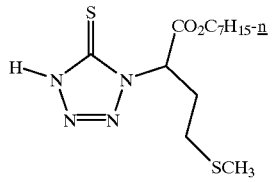

HT-5:

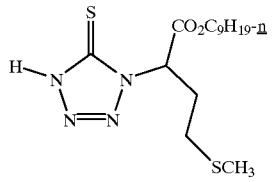

HT-6:

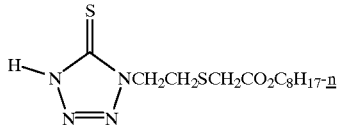

HT-8:

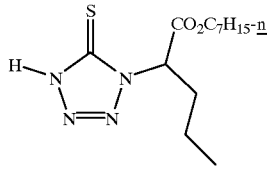

HT-9:

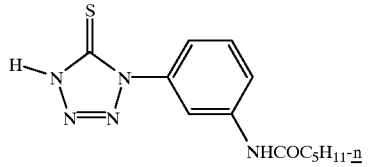

HT-26:

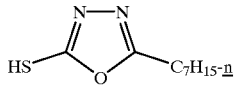

12. The color photographic element of claim 1 wherein the layer containing the heterocyclic thiol compound also contains an interlayer scavenger.

13. The color photographic element of claim 12 wherein the interlayer scavenger is a hydroquinone compound.

14. The color photographic element of claim 1 wherein the solvent is selected from the group consisting of tricresylphosphate, N,N-diethyllauramide, N,N'-dibutyllauramide, p-dodecylphenol, dibutylpthalate, di-n-butyl sebacate, N-n-butylacetanilide, 9-octadec-en-1-ol, trioctylamine and 2-ethylhexylphosphate.

15. The color photographic element of claim 1 which additionally contains at least one bleach accelerator releasing material.

16. The color photographic element of claim 6 which additionally contains at least one bleach accelerator releasing material.

17. The color photographic element of claim 9 which contains in a red light sensitive imaging layer at least one bleach accelerator releasing material.

* * * * *